US011391089B2

(12) United States Patent
Wernberg et al.

(10) Patent No.: US 11,391,089 B2
(45) Date of Patent: Jul. 19, 2022

(54) STEPLADDER FOLDING LEG

(71) Applicant: Tricam Industries, Inc., Eden Prairie, MN (US)

(72) Inventors: Benjamin M. Wernberg, Eden Prairie, MN (US); Benjamin P. Williams, Chaska, MN (US); Joseph P. Foley, St. Paul, MN (US); Dennis D. Simpson, Plymouth, MN (US)

(73) Assignee: Tricam Industries, Inc., Eden Prairie, MN (US)

( * ) Notice: Subject to any disclaimer, the term of this patent is extended or adjusted under 35 U.S.C. 154(b) by 265 days.

(21) Appl. No.: 16/661,419

(22) Filed: Oct. 23, 2019

(65) Prior Publication Data

US 2020/0131850 A1 Apr. 30, 2020

Related U.S. Application Data

(60) Provisional application No. 62/749,871, filed on Oct. 24, 2018.

(51) Int. Cl.

| | |
|---|---|
| ***E06C 7/42*** | (2006.01) |
| ***E06C 1/387*** | (2006.01) |
| ***E06C 1/18*** | (2006.01) |
| ***E06C 7/16*** | (2006.01) |
| ***E06C 7/44*** | (2006.01) |
| ***E06C 7/46*** | (2006.01) |
| ***E06C 1/38*** | (2006.01) |
| ***E06C 1/16*** | (2006.01) |

(52) U.S. Cl.
CPC . *E06C 1/38* (2013.01); *E06C 1/16* (2013.01)

(58) Field of Classification Search
CPC ... E06C 1/38; E06C 1/16; E06C 1/387; E06C 1/18; E06C 7/42; E06C 7/423; E06C 7/426; E06C 7/16; E06C 7/44; E06C 7/46
See application file for complete search history.

(56) References Cited

U.S. PATENT DOCUMENTS

| | | | | |
|---|---|---|---|---|
| 1,331,953 | A | 2/1920 | Brown | |
| 3,037,581 | A * | 6/1962 | Feltrop | E06C 7/44 182/202 |
| 4,926,968 | A | 5/1990 | Schumer | |
| 9,145,733 | B2 * | 9/2015 | Worthington | E06C 7/423 |
| 9,309,718 | B1 * | 4/2016 | Matthew | E06C 1/16 |
| 9,879,481 | B2 * | 1/2018 | Fitzgerald | E06C 7/44 |
| 10,871,031 | B1 * | 12/2020 | Moss | B29C 70/52 |
| 2008/0230316 | A1 * | 9/2008 | Worthington | E06C 7/44 182/111 |
| 2010/0300805 | A1 * | 12/2010 | Moss | E06C 1/12 182/172 |
| 2012/0037454 | A1 * | 2/2012 | Fitzgezald | E06C 7/42 182/201 |
| 2013/0186710 | A1 * | 7/2013 | Moss | E06C 7/185 182/104 |
| 2014/0083799 | A1 * | 3/2014 | Evans | E06C 7/44 182/202 |

(Continued)

*Primary Examiner* — Brian D Mattei
*Assistant Examiner* — Kathleen M. McFarland
(74) *Attorney, Agent, or Firm* — Patterson Thuente Pedersen, P.A.

(57) ABSTRACT

A folding leg for a stepladder is disclosed. The folding leg allows the width of the stepladder base to be narrowed when in the stored orientation and widened while in an in-use orientation.

20 Claims, 19 Drawing Sheets

(56) References Cited

U.S. PATENT DOCUMENTS

| | | | | |
|---|---|---|---|---|
| 2014/0131541 | A1* | 5/2014 | Polzen | E06C 7/423<br>248/351 |
| 2014/0202793 | A1* | 7/2014 | Jonas | E06C 7/423<br>182/108 |
| 2015/0252620 | A1* | 9/2015 | Walsh | E06C 7/423<br>182/107 |
| 2016/0222729 | A1* | 8/2016 | Shih | E06C 7/42 |
| 2018/0094488 | A1* | 4/2018 | Major | E06C 7/44 |
| 2019/0390518 | A1* | 12/2019 | Yoo | E06C 7/081 |
| 2022/0025704 | A1* | 1/2022 | Bibler | E06C 7/04 |

* cited by examiner

STEPLADDER FOLDING LEG

CROSS-REFERENCE TO RELATED APPLICATION

The present application claims the benefit of U.S. Provisional Application No. 62/749,871, filed Oct. 24, 2018, which is hereby incorporated herein in its entirety by reference.

TECHNICAL FIELD

The present disclosure relates generally to a ladder. More particularly, the present invention relates to a folding leg for a stepladder that allows for a wider leg width when the ladder is in use, but allows for the legs to be folded to a stored position that has the same width as the upper rails.

BACKGROUND

Stepladders have historically been manufactured with a fixed width. Improvements to stepladders included providing a wider base width to increase stability. For example, U.S. Pat. No. 1,331,953 discloses a stepladder with an automatic spreading and bracing means. Other improvements to stepladder stability included additional exterior bracing to prevent swaying such as U.S. Pat. No. 4,926,968. It is desirable to have improved stability on the climbing side of the ladder by widening the stance of the ladder during use while allowing the ladder to be narrowed for storage.

SUMMARY OF THE INVENTION

The present invention is directed to an improved ladder rail for a stepladder. The ladder rail is adjustable between a use position and a stored position. The use position increases the stance or spread of the rails at the bottom of the climbing side of the stepladder from that of the stored position. The stance of the stepladder in the stored position is the same width as the upper rail portion of the stepladder. Another aspect of the invention is that the mechanism for adjusting the spread of the rails is incorporated into the bottom step of the stepladder. Yet another aspect of the invention is the mechanism can be controlled with one foot, allowing a single user to hold the stepladder upright when adjusting the stepladder between the use and stored positions.

The above summary is not intended to describe each illustrated embodiment or every implementation of the subject matter hereof. The figures and the detailed description that follow more particularly exemplify various embodiments.

BRIEF DESCRIPTION OF THE DRAWINGS

The disclosure can be more completely understood in consideration of the following detailed description of various embodiments of the disclosure, in connection with the accompanying drawings, in which.

DETAILED DESCRIPTION

Figure 1:
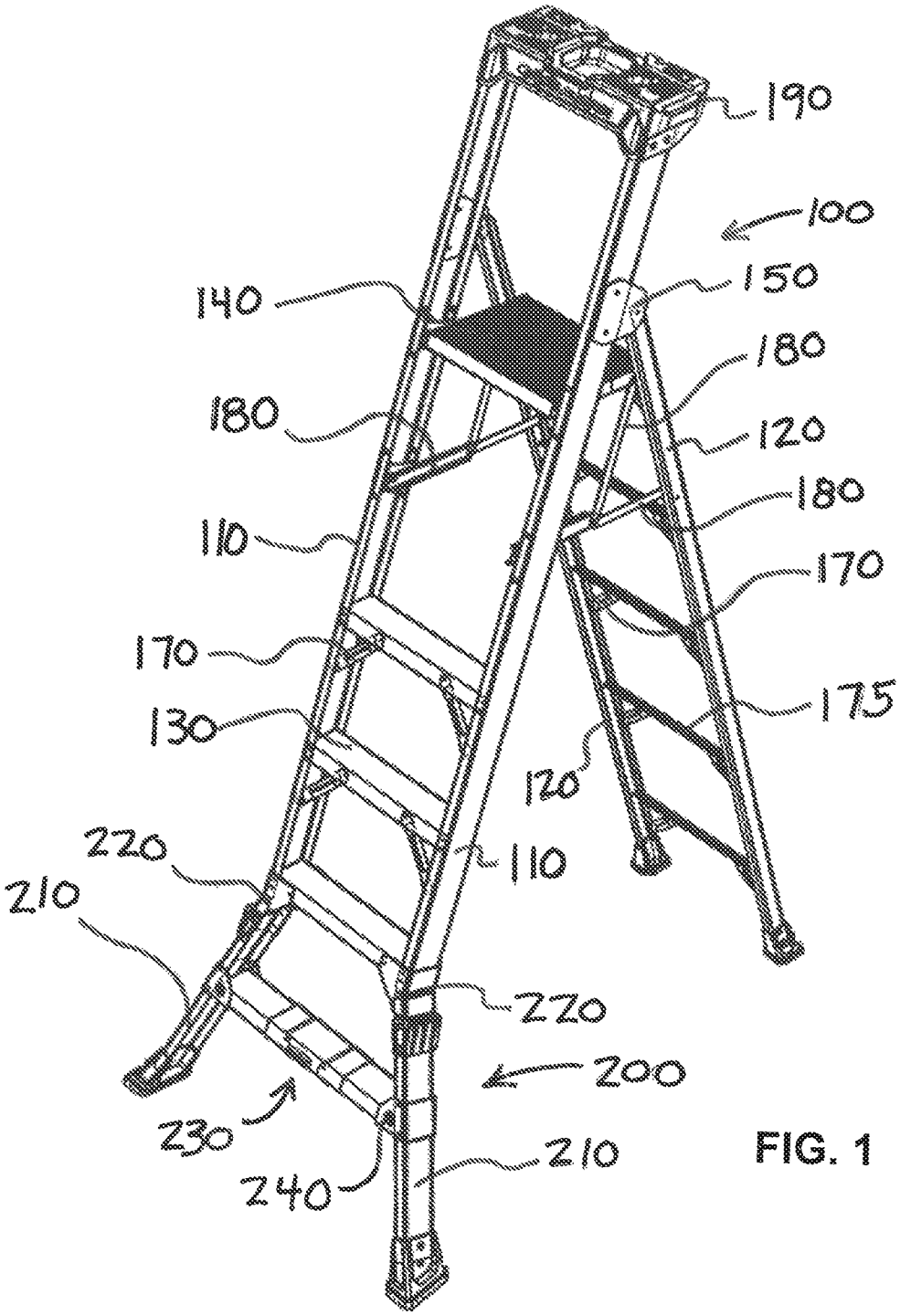
FIG. 1 is a front perspective view depicting a stepladder in accordance with an embodiment of the disclosure in a use orientation.
Figure 2:
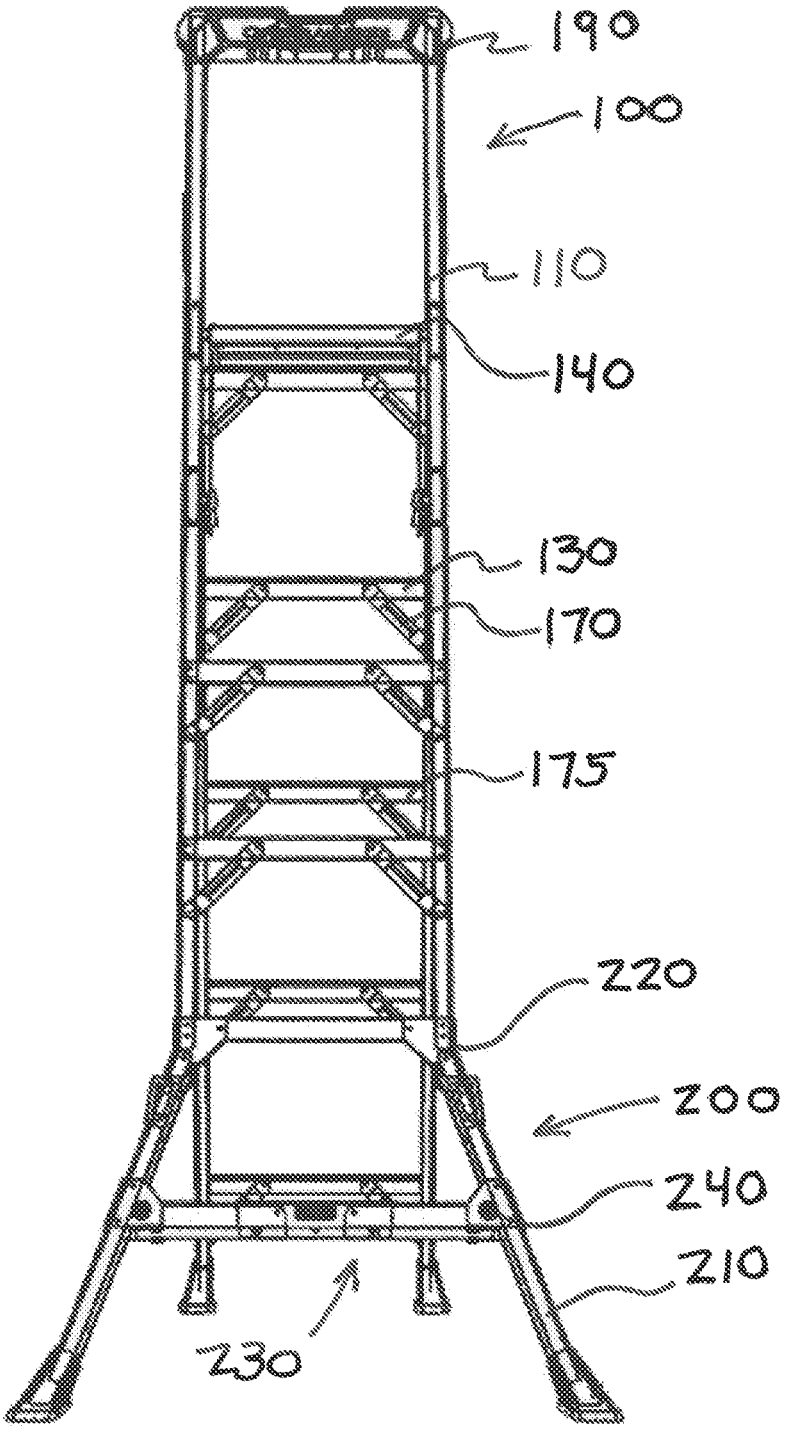
FIG. 2 is a front elevation view of the stepladder of FIG. 1.
Figure 3:
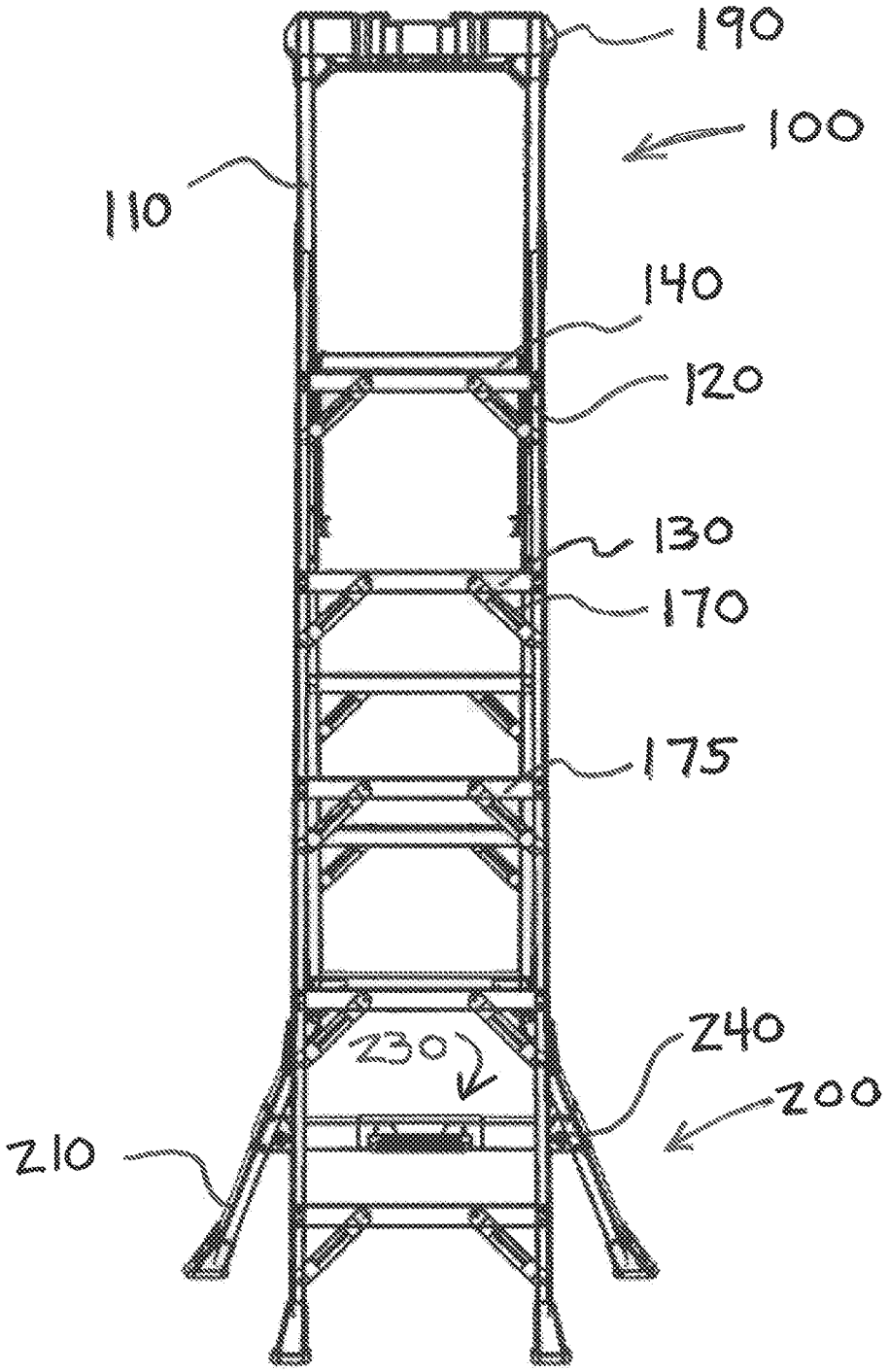
FIG. 3 is a rear elevation view of the stepladder of FIG. 1.
Figure 4:
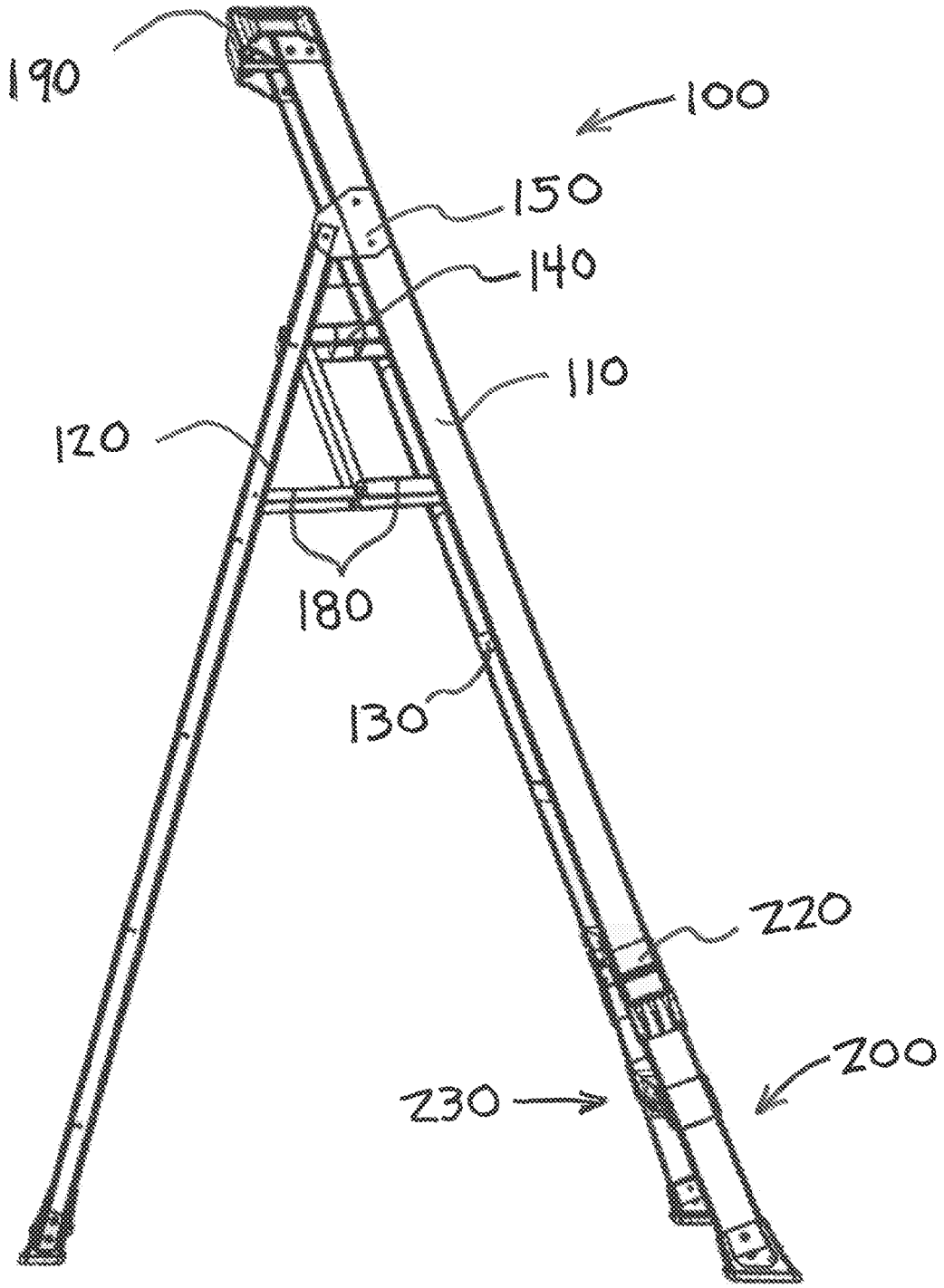
FIG. 4 is a left elevation view of the stepladder of FIG. 1.
Figure 5:
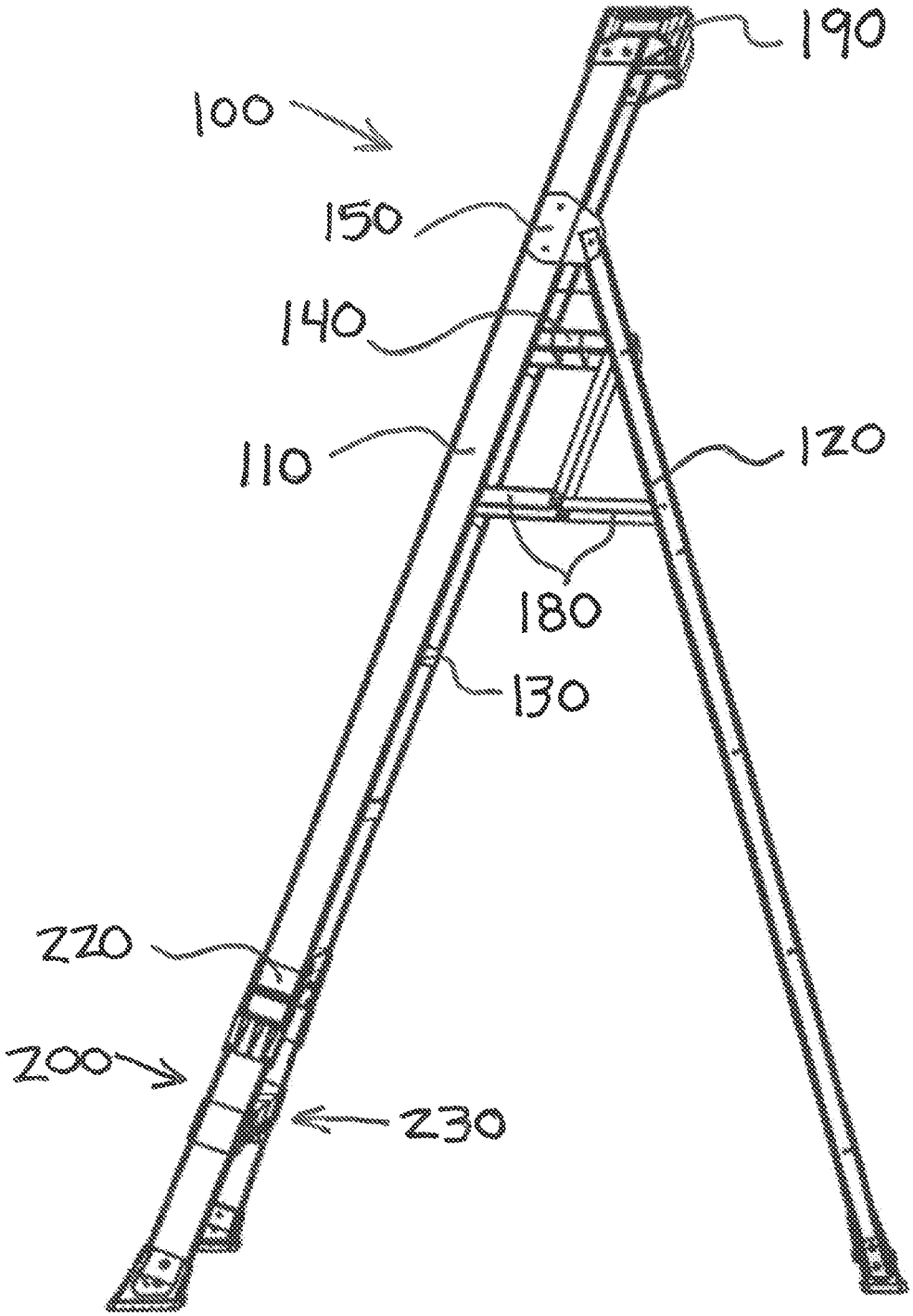
FIG. 5 is a right elevation view of the stepladder of FIG. 1.
Figure 6:
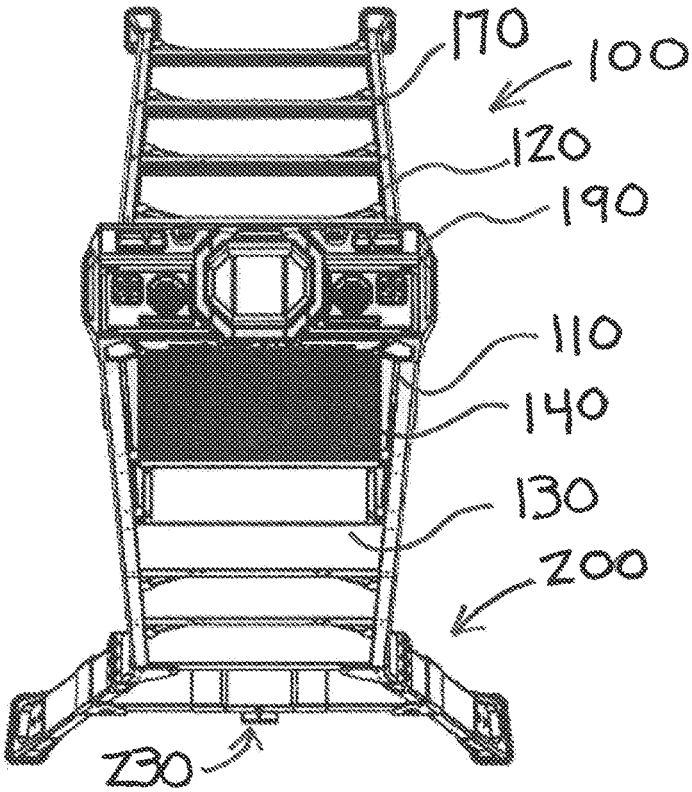
FIG. 6 is a top view of the stepladder of FIG. 1.
Figure 7:
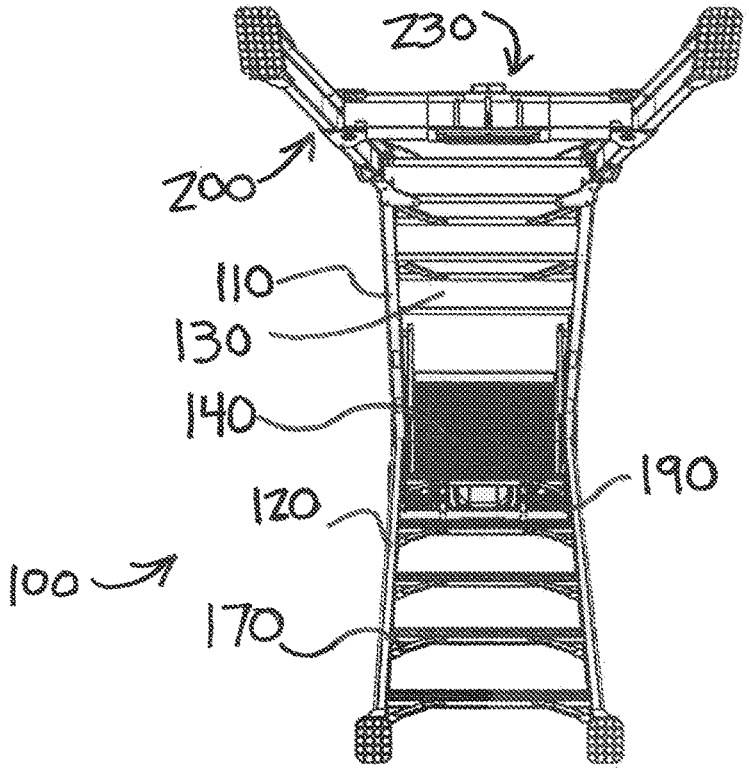
FIG. 7 is a bottom view of the stepladder of FIG. 1
Figure 8:
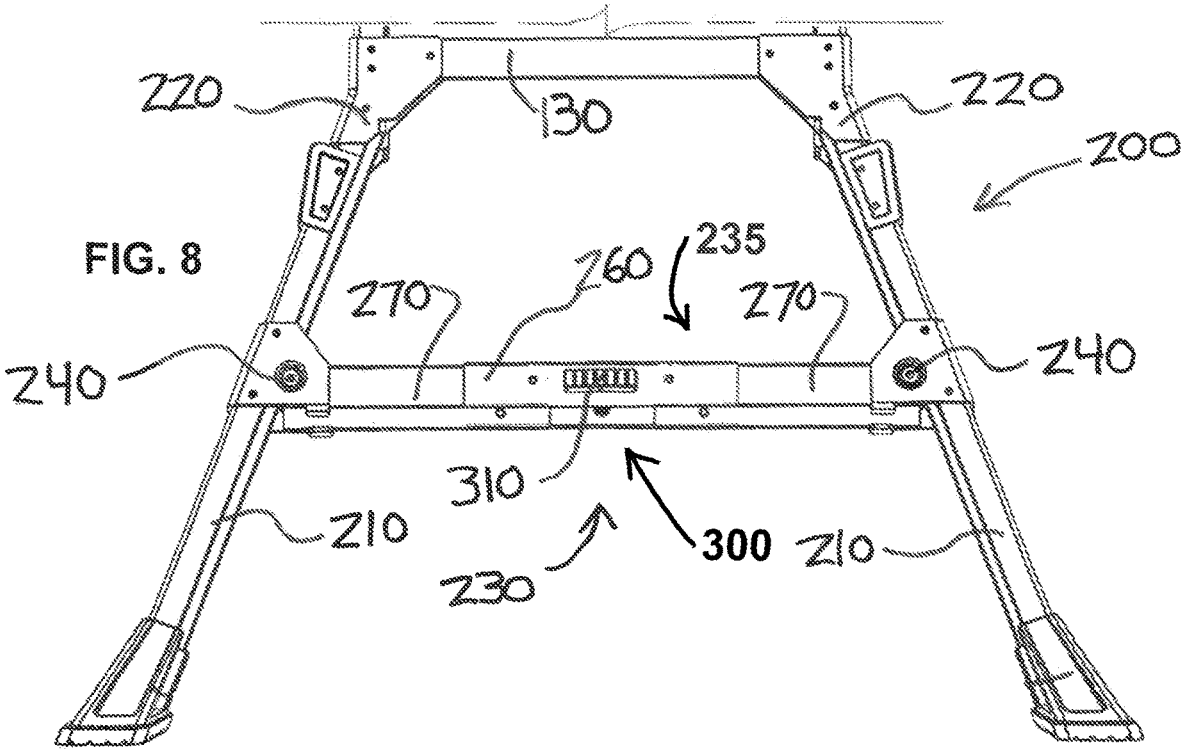
FIG. 8 is a front isolation view of the adjustable legs of FIG. 1.
Figure 9:
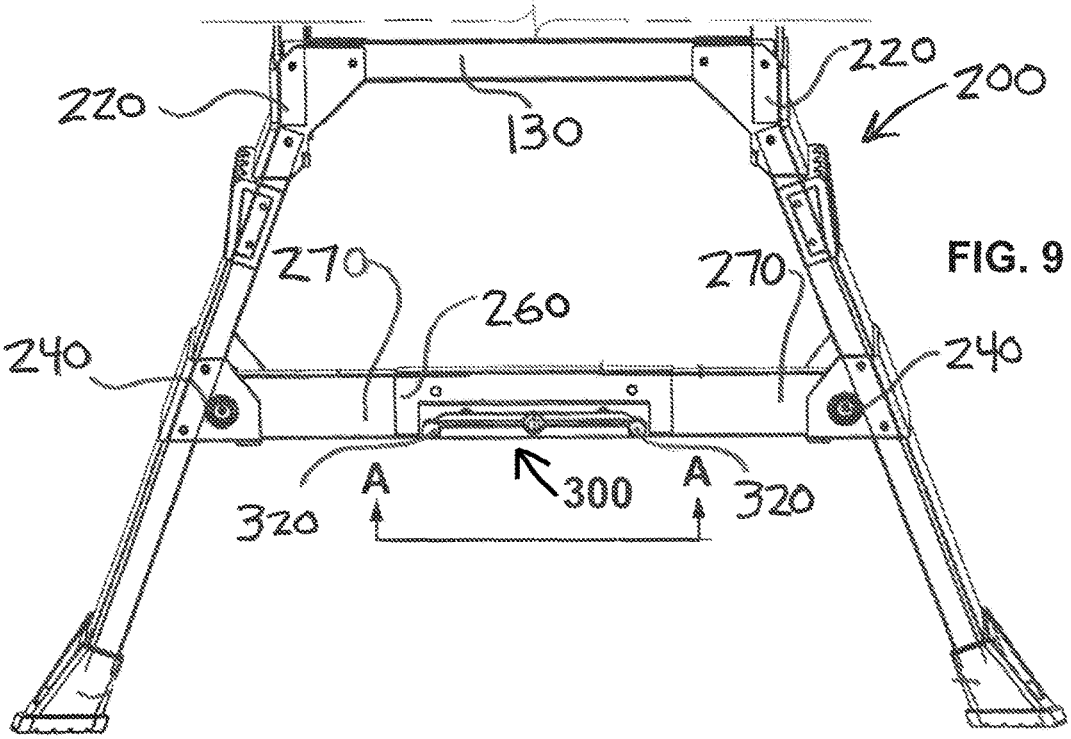
FIG. 9 is a rear isolation view of the adjustable legs of FIG. 8.
Figure 10:
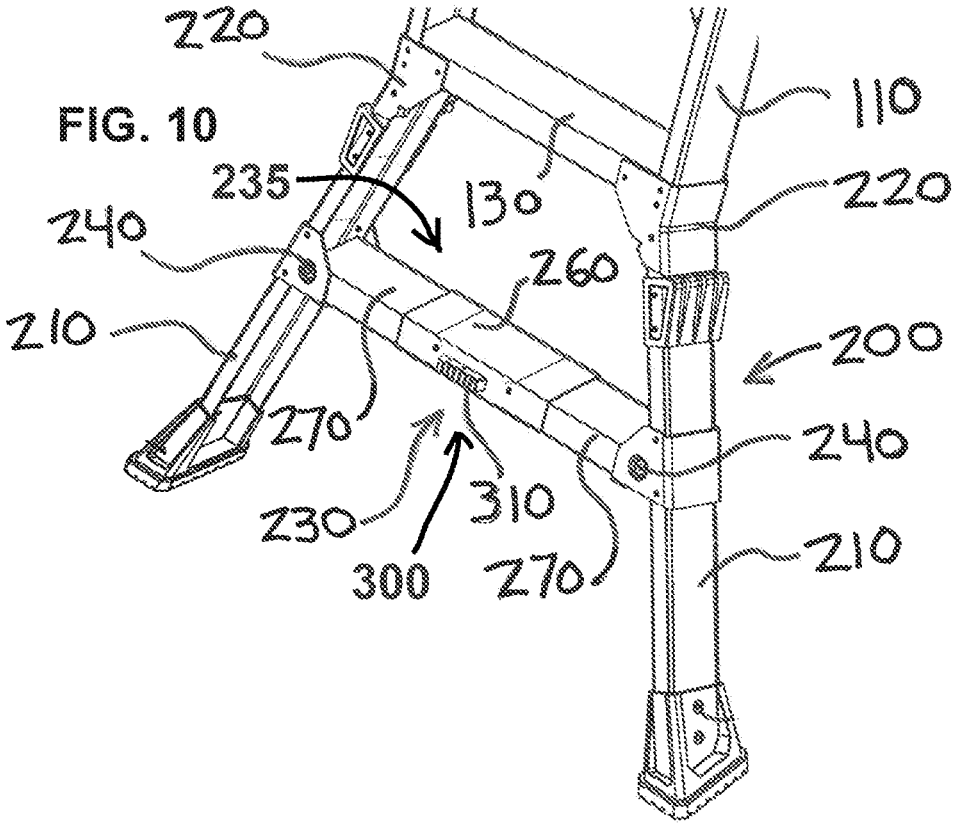
FIG. 10 is a front perspective view of the adjustable legs of FIG. 8.
Figure 11:
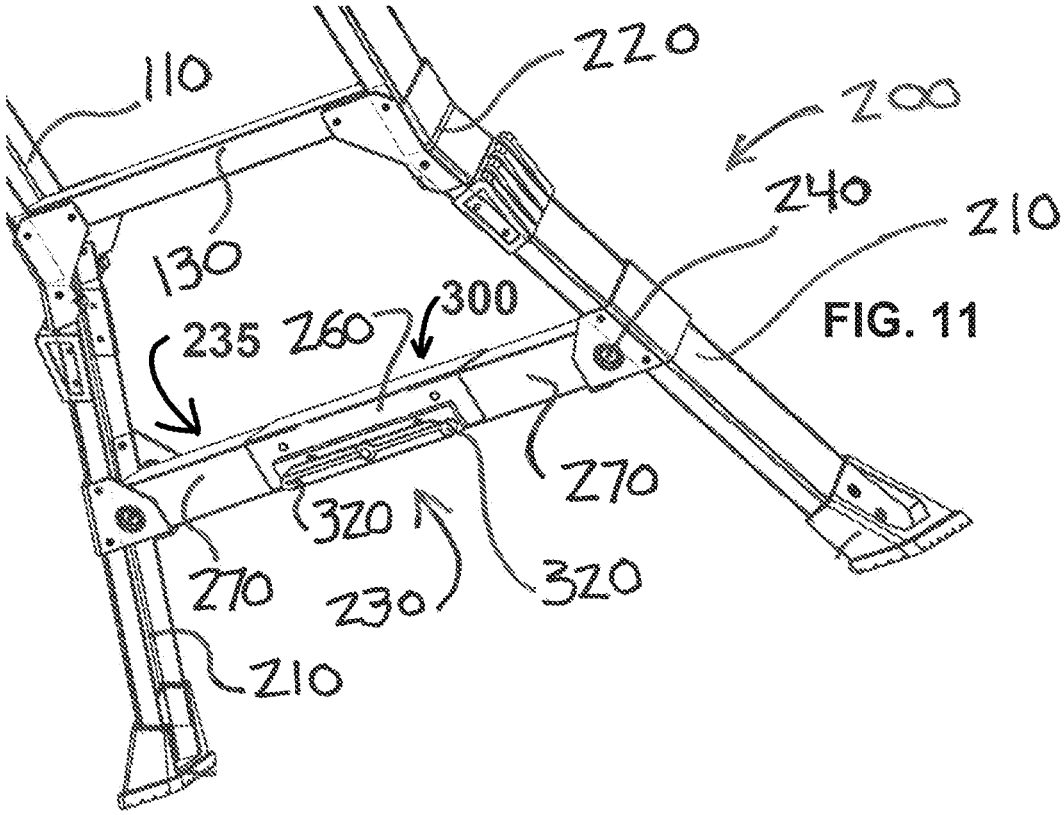
FIG. 11 is a rear perspective view of the adjustable legs of FIG. 8.
Figure 12:
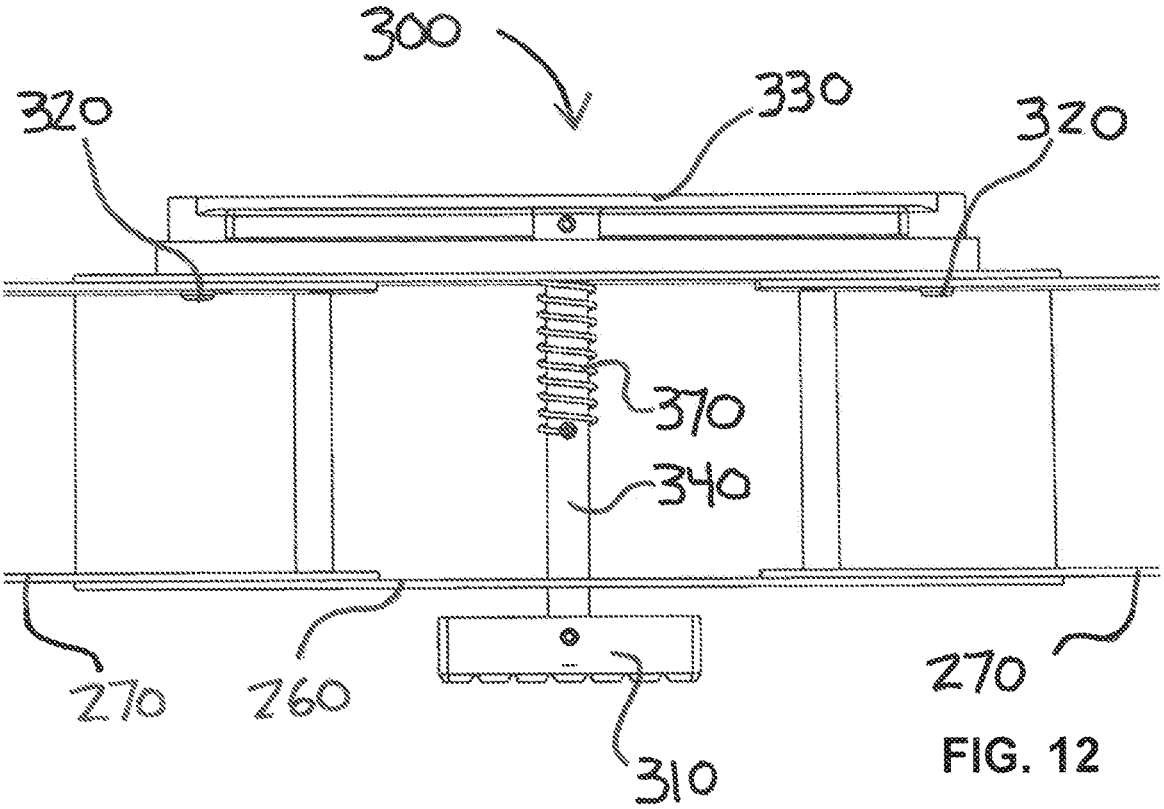
FIG. 12 is a bottom detailed view of FIG. 9 taken along line A-A.
Figure 13:
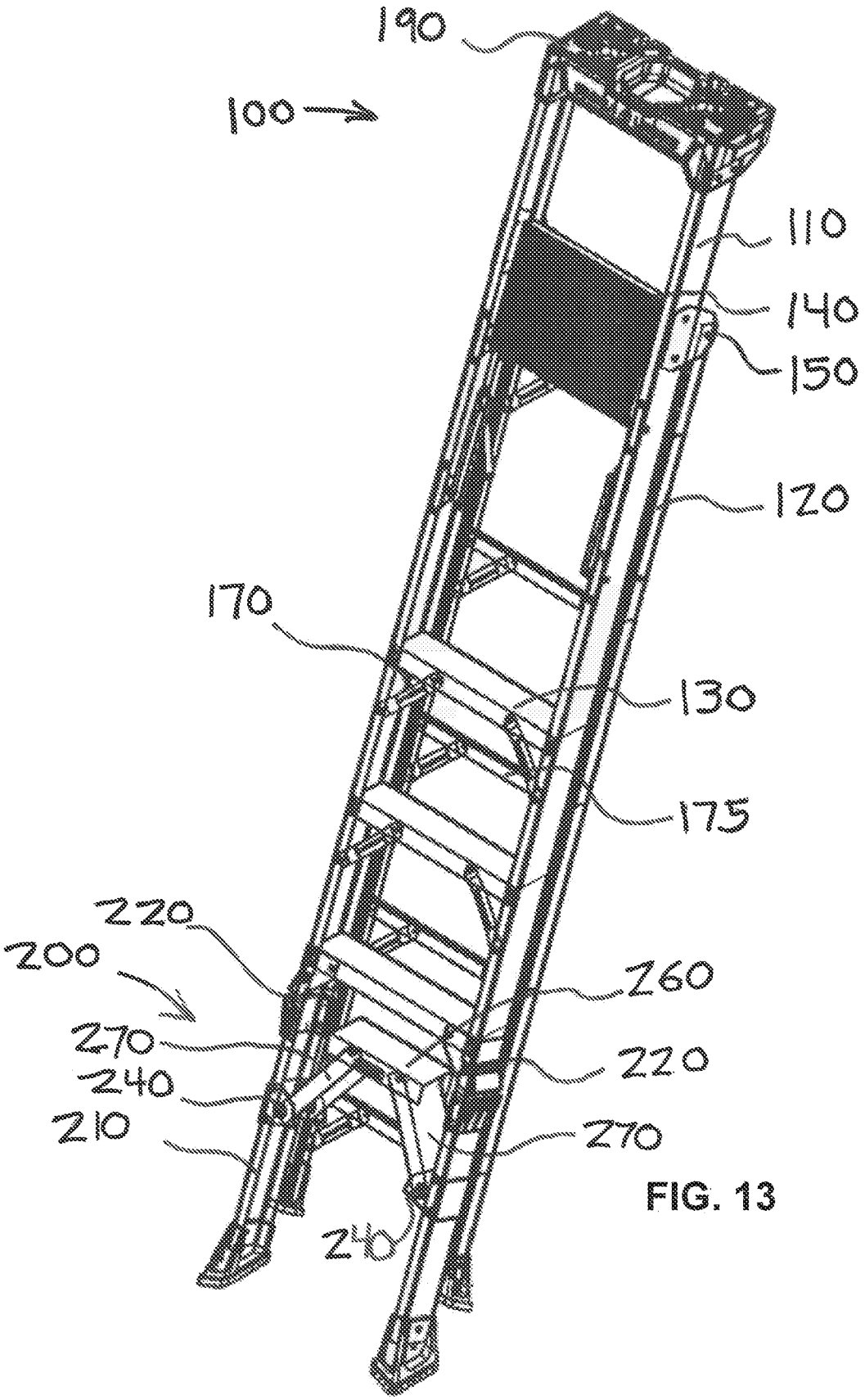
FIG. 13 is a front perspective view depicting a stepladder in accordance with an embodiment of the disclosure in a stored orientation.
Figure 14:
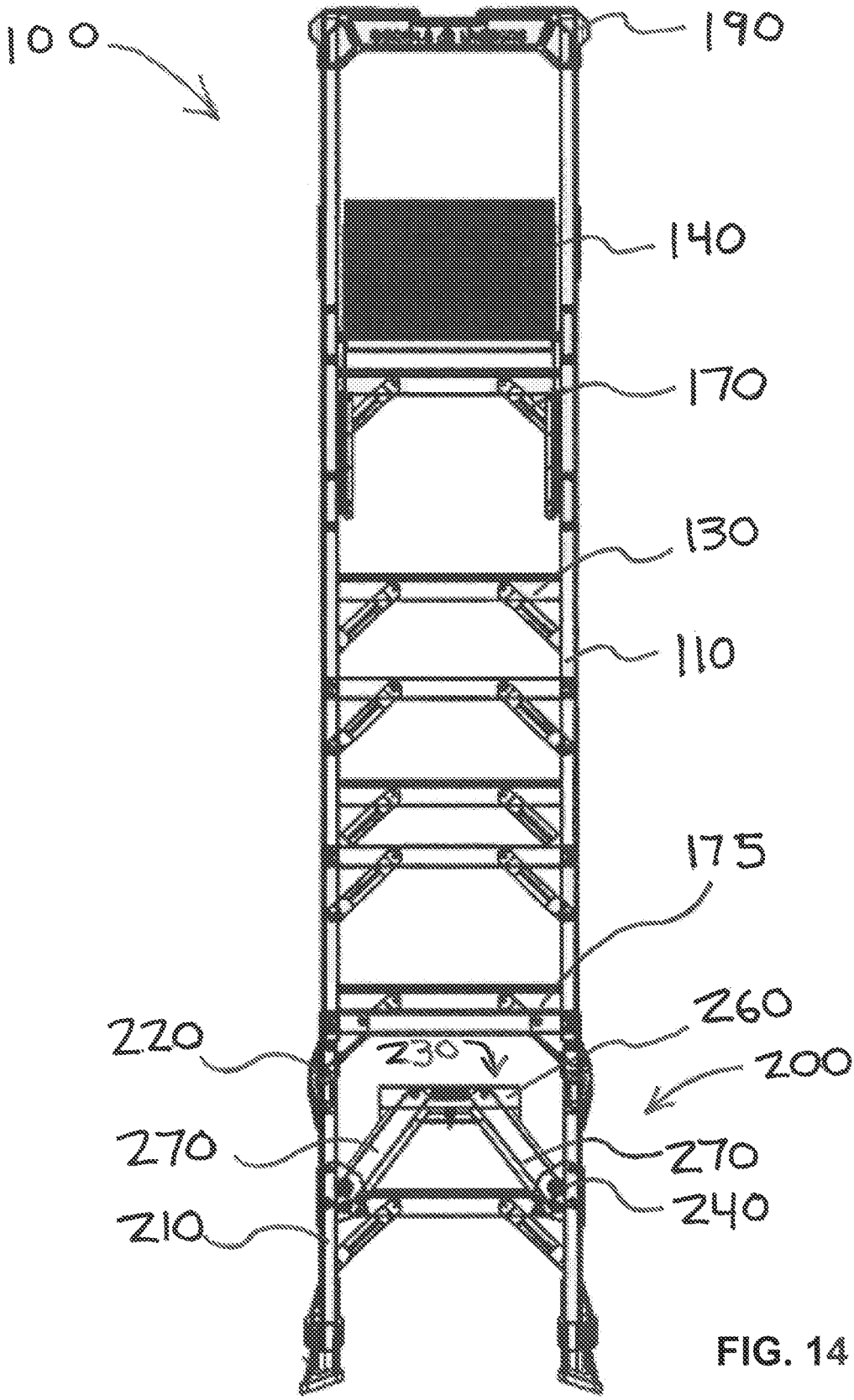
FIG. 14 is a front elevation view of the stepladder of FIG. 13.
Figure 15:
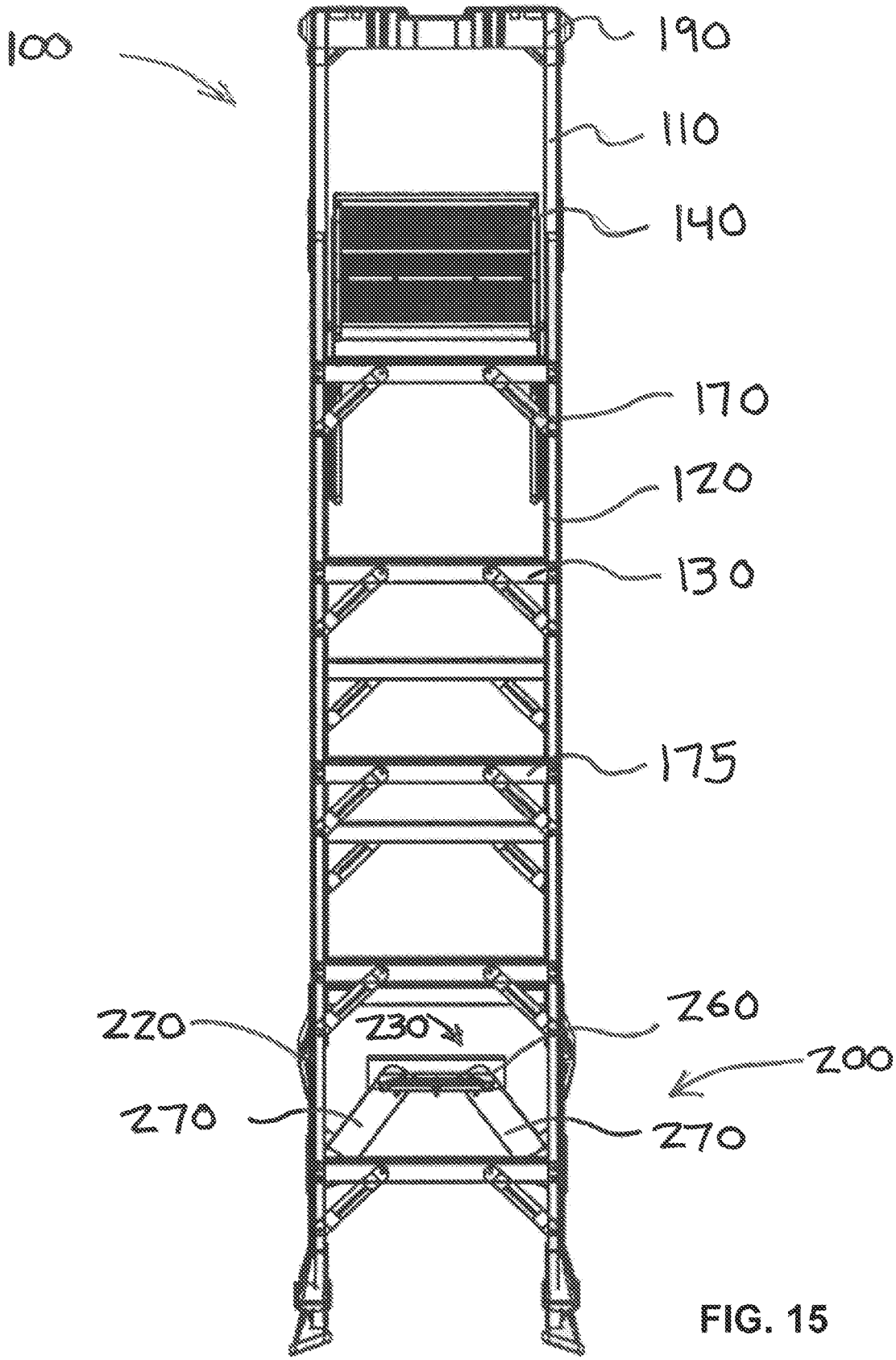
FIG. 15 is a rear elevation view of the stepladder of FIG. 13.
Figure 16:
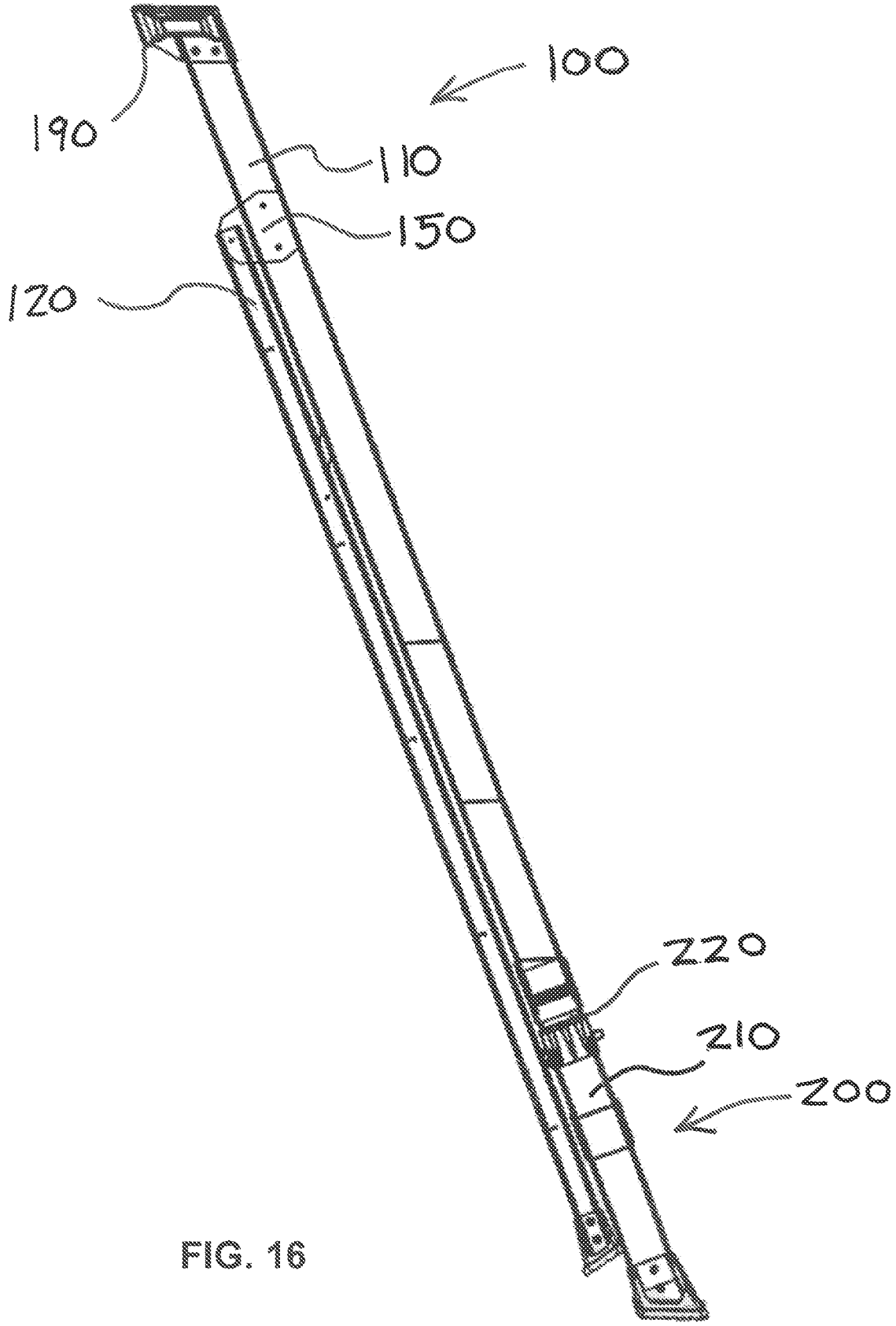
FIG. 16 is a left elevation view of the stepladder of FIG. 13.
Figure 17:
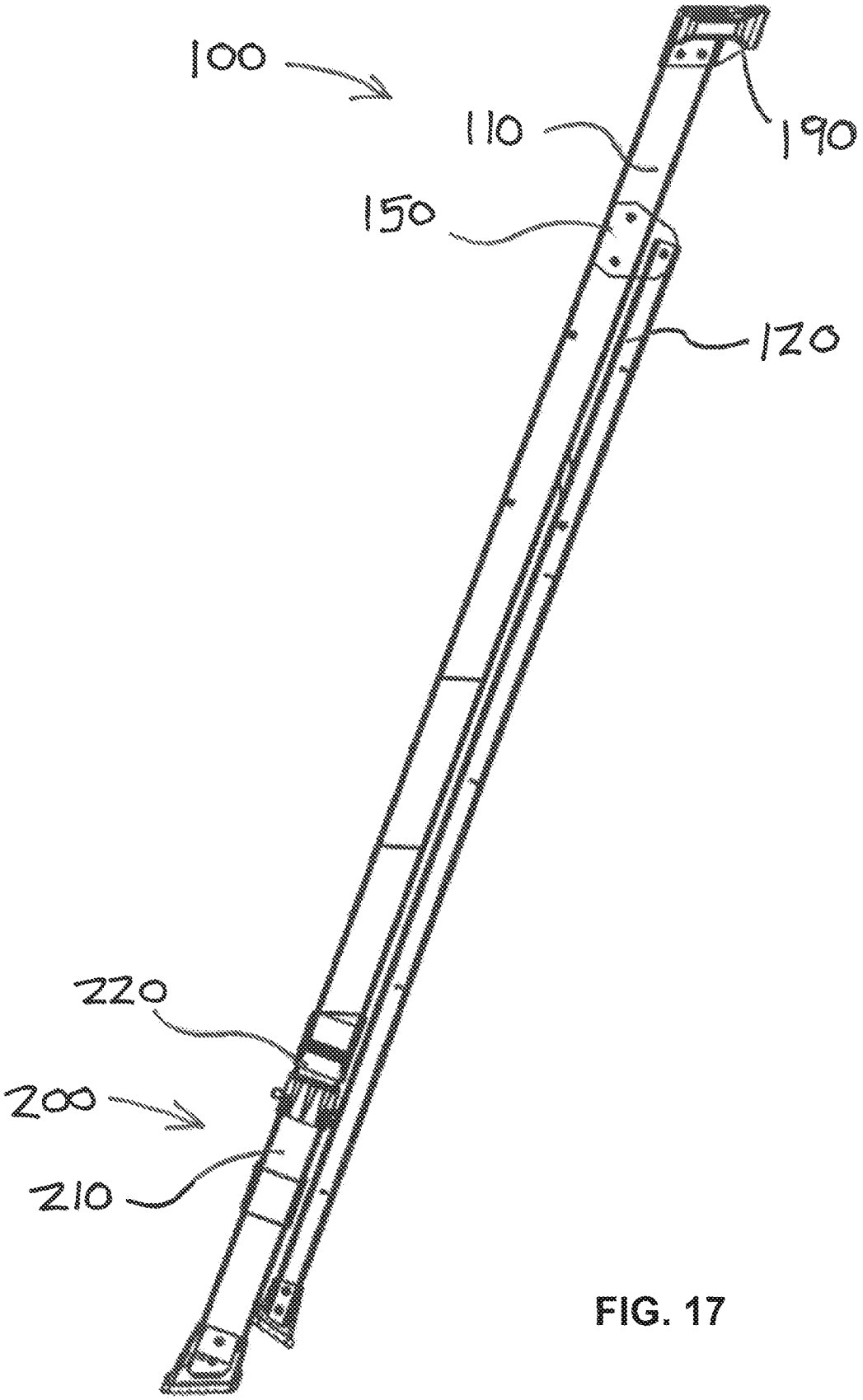
FIG. 17 is a right elevation view of the stepladder of FIG. 13.
Figure 18:
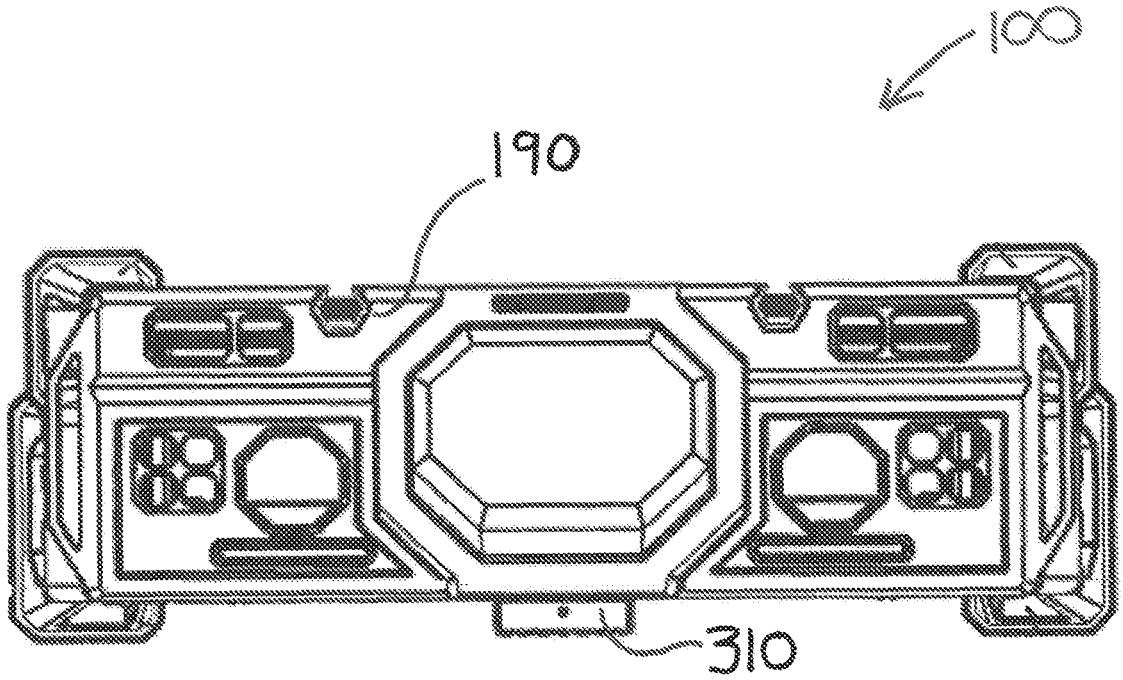
FIG. 18 is a top view of the stepladder of FIG. 13.
Figure 19:
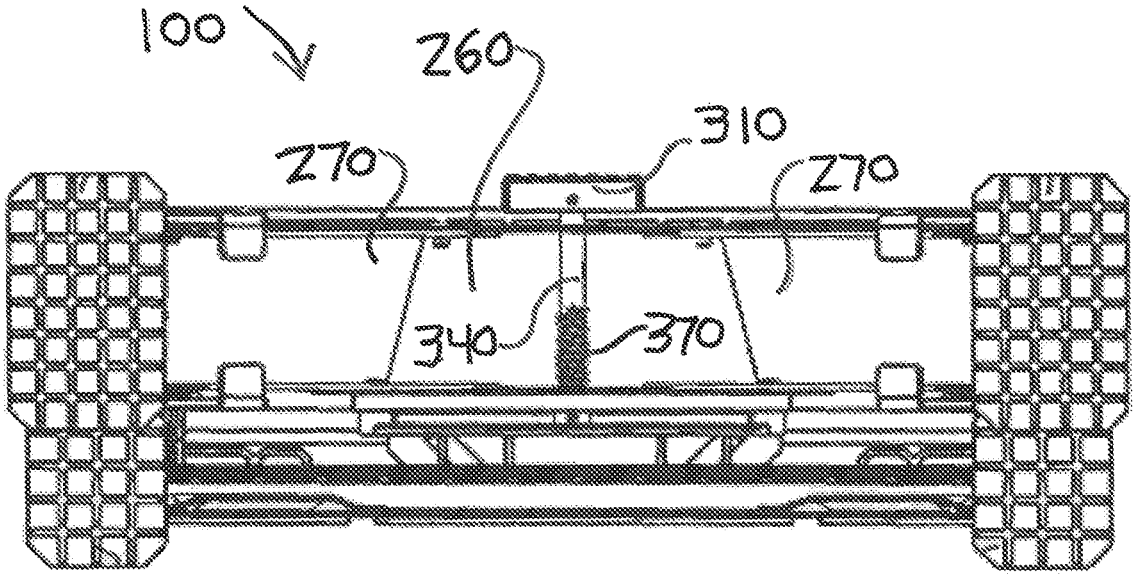
FIG. 19 is a bottom view of the stepladder of FIG. 13
Figure 20:
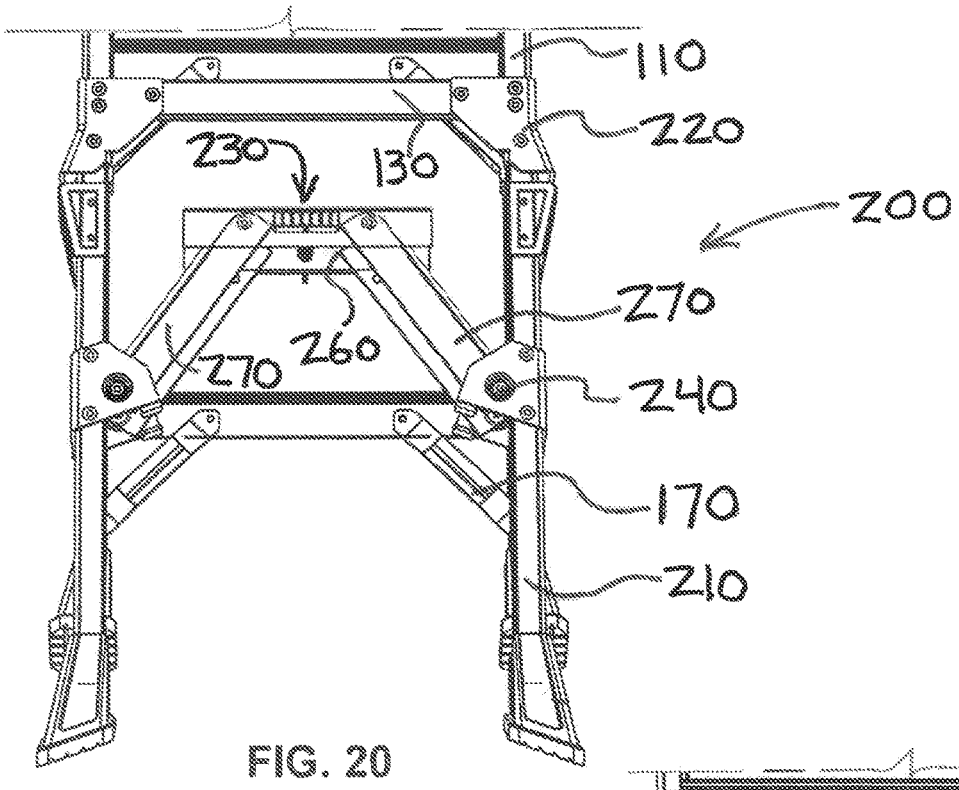
FIG. 20 is a front isolation view of the adjustable legs of FIG. 13.
Figure 21:
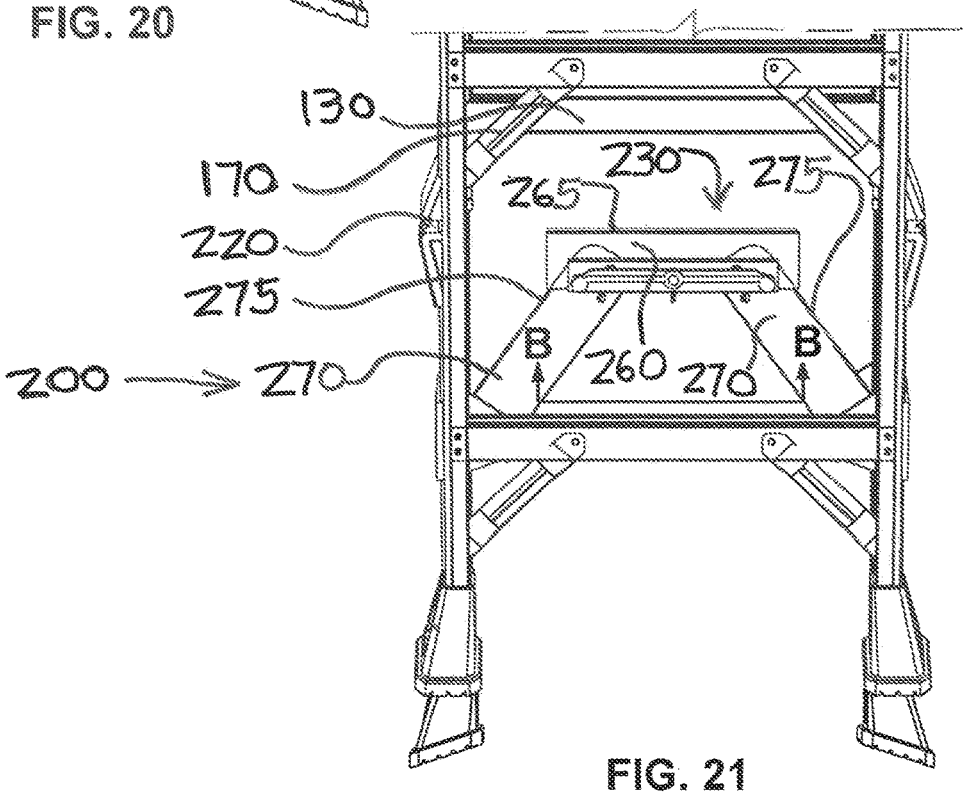
FIG. 21 is a rear isolation view of the adjustable legs of FIG. 20.
Figure 22:
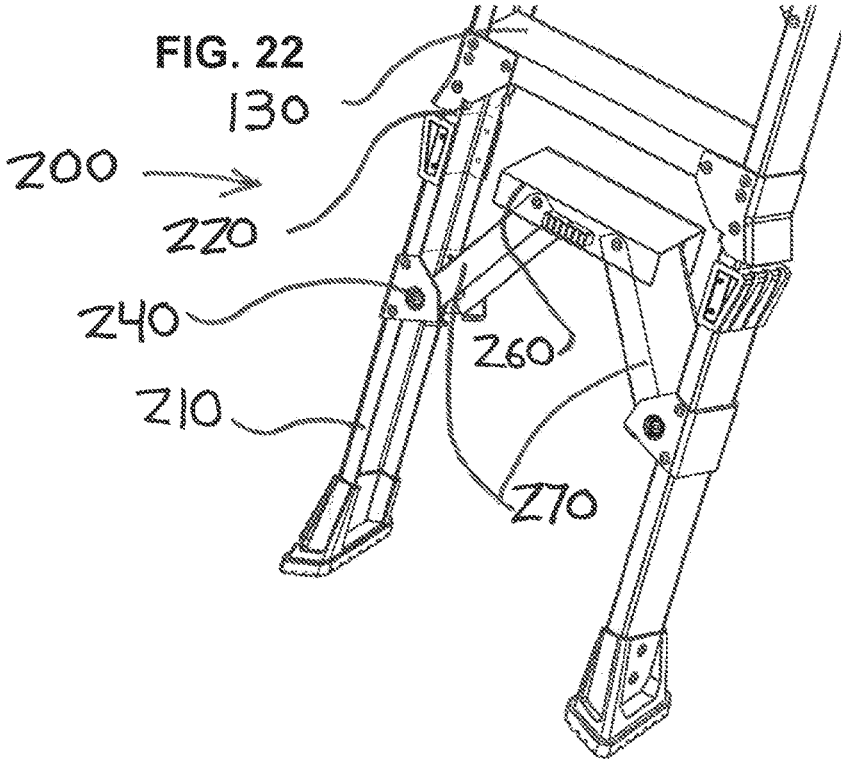
FIG. 22 is a front perspective view of the adjustable legs of FIG. 20.
Figure 23:
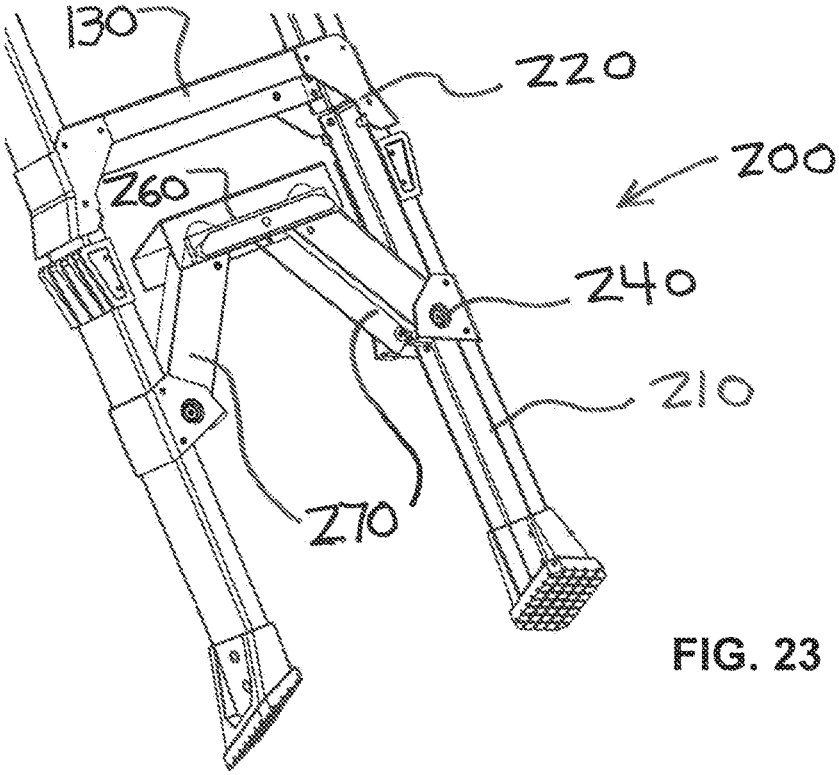
FIG. 23 is a rear perspective view of the adjustable legs of FIG. 20.

A stepladder according to an embodiment of the invention is depicted in FIGS. 1-11 and 13-23 by reference numeral 100. Stepladder 100 has front rails 110 and rear rails 120 with a hinge 150 between to allow the stepladder 100 to be placed in an in-use orientation (FIGS. 1-11) or in a stored orientation (FIGS. 13-23). Stepladder 100 typically has steps 130 or rungs between front rails 110 and potentially between rear rails 120. In lieu of steps 130 or rungs between rear rails 120, cross braces 175 may be used to separate, connect, and support rear rails 120. Braces 170 may be used to further support steps 130 and cross braces 175. A top cap 190 may be added to the upper portion of the stepladder 100 to provide a work or tool storage surface and to provide a barrier to increase user safety when on the top step 130 or platform 140 of stepladder 100.

Stepladder 100 may also have one or more platforms 140 to provide a more secure standing area when stepladder 100 is in use. Platforms 140 for stepladders 100 are typically folding and rely upon links 180 to move the platform 140 from a stored configuration to an in-use configuration. Stepladders 100 also commonly have a foot on the end of the front rails 110 and rear rails 120 to protect surfaces onto which the stepladder 100 is placed and to provide a wider footprint and better traction for the stepladder 100.

The stepladder 100 of the present invention contemplates having a folding leg 200 at the bottom of the front rails 110 that allows the front rails 110 to spread wider during use of the stepladder 100, but allow the front rails 110 to narrow during storage of the stepladder 100. The spreading and narrowing of the folding leg 200 may be safely accomplished by a single person using just a foot, which allows using both hands to stand the stepladder 100 in an upright position while modifying its orientation.

In one embodiment, folding leg 200 comprises rail legs 210 as extensions of the front rails 110. The rail legs 210 are each pivotably attached to their respective rail legs 210 by a leg hinge 220. A moveable step 230 spans between the rail legs 210 to form the bottom step of the stepladder 100. The moveable step 230 is preferably made of two moveable step wings 270, each pivotably attached to a respective rail leg 210 by a moveable step-leg hinge 240 and having a moveable step wing tread surface, and a moveable step center 260, pivotably attached at each end to step wing 270 and having a moveable step wing center tread surface. Hinges 220, 240 may comprise any type of hinge known in the art (bi-fold, butt, offset, overlay, etc.). Other means of allowing the rail legs 210 to pivot and the moveable step wings to pivot other than hinges 220, 240 may be used. For example, a linkage could be used in place of hinges 220, 240. It is also contemplated that a folding leg 200 may be used as an extension of the rear rails 120 of the stepladder.

Figure 24:
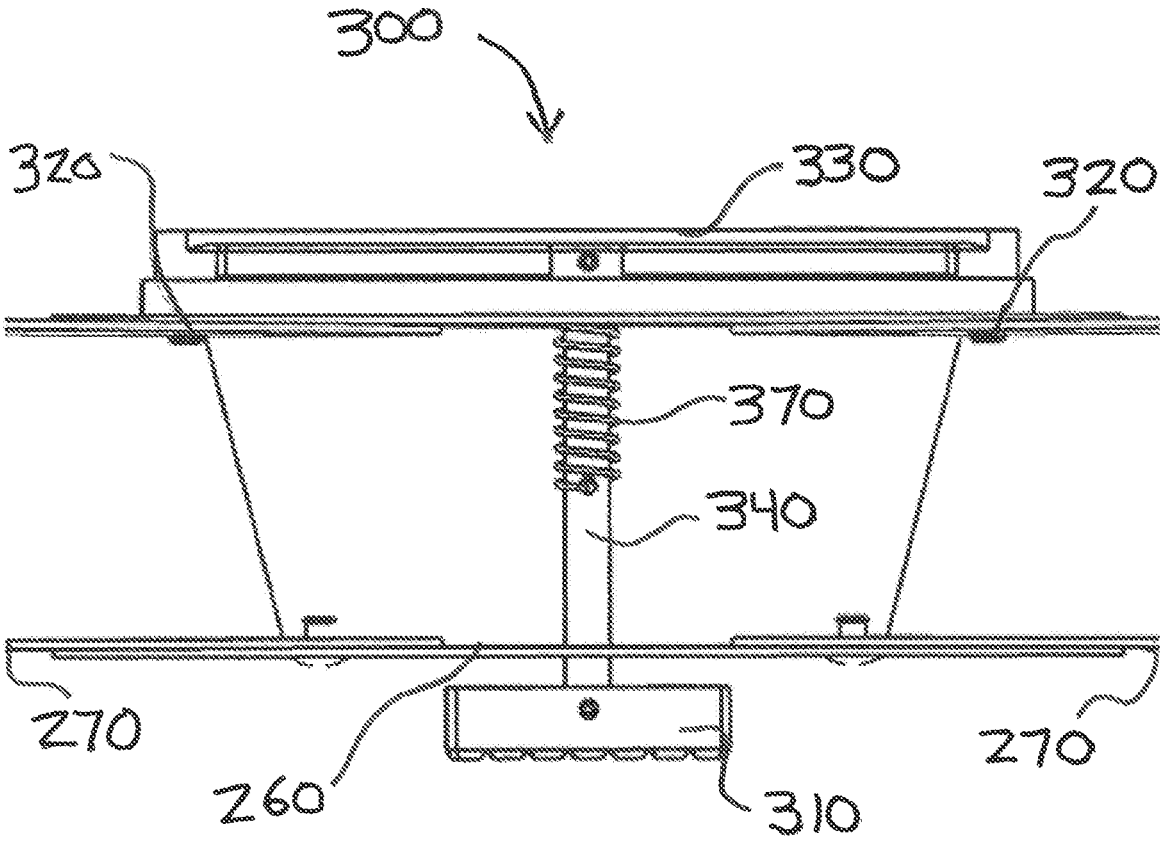
FIG. 24 is a bottom detailed view of FIG. 21 taken along line B-B.

FIGS. 8-11 provide more detailed views of the folding leg 200 and lock 300 of the stepladder 100 in the in-use orientation and FIGS. 20-24 provide more detailed views of the folding leg 200 and lock 300 of the stepladder 100 in the stored orientation. When in the in-use orientation, the moveable step wings 270 are parallel with the moveable step center 260 to form a single moveable step 230 having a continuous moveable step tread surface 235.

When in the stored orientation, moveable step center 260 is raised to pivot moveable step wings 270 at their respective connections to the moveable step center 260, which in turn pivots the moveable step wings 270 at the moveable step-leg hinges 240 to pivot the rail legs 210 at the leg hinges 220 and allow the rail legs 210 to rotate inward and parallel to the front rails 110. The abutting ends of the rail legs 210 and respective front rails 110 may be formed to mate when the rail legs 210 are parallel with their respective front rails 110, thus preventing overpivoting of the rail legs 210 and leaving a gap between the raised moveable step center 260 and the adjacent step 130, allowing for placement of a foot. This arrangement allows a user to place a foot on the moveable step center 260 and apply force to move the folding leg 200 from a stored orientation to an in-use orientation.

Figure 25:
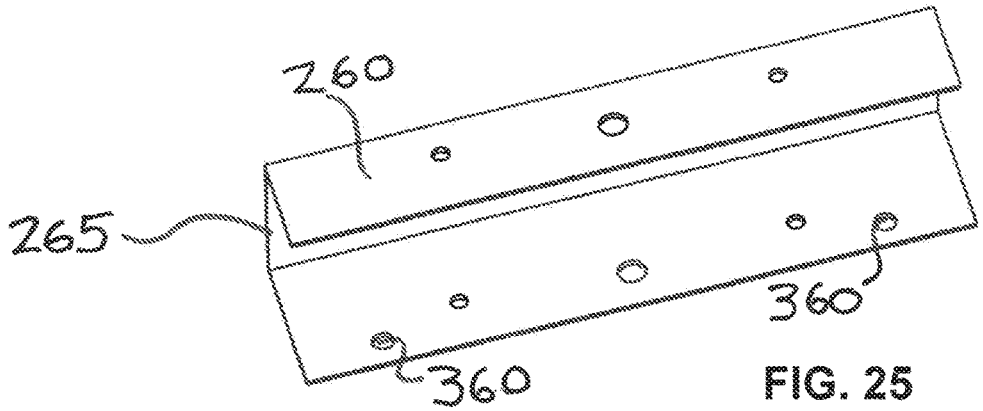
FIG. 25 is a front isolation view of a moveable step center in accordance with an embodiment of the disclosure.
Figure 26:
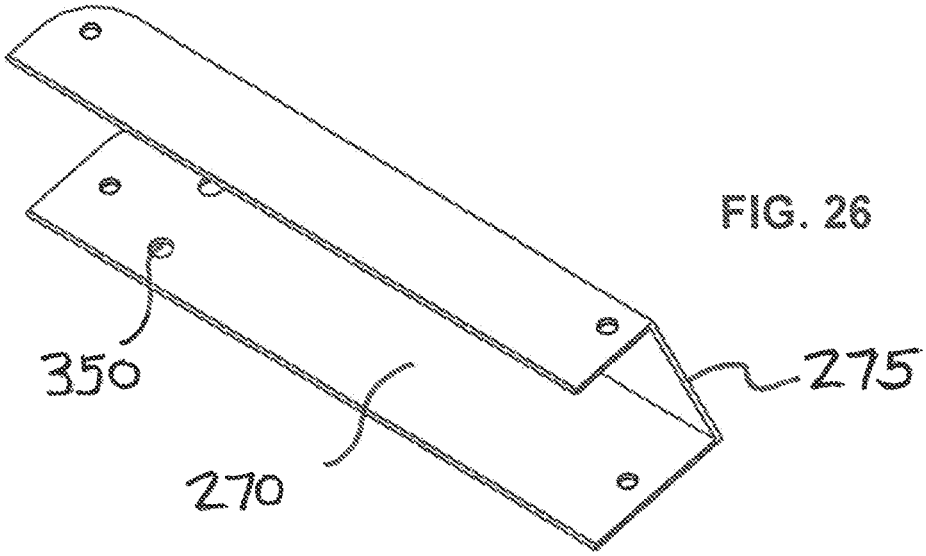
FIG. 26 is a front isolation view of a moveable step wing in accordance with an embodiment of the disclosure.
Figure 27:
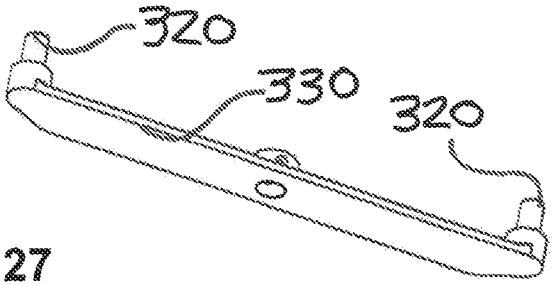
FIG. 27 is a rear isolation view of a pin bar in accordance with an embodiment of the disclosure While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

It is advantageous to maintain the moveable step 230 in the in-use orientation until a user deliberately moves to alter the stepladder 100 to a storage orientation, thus preventing inadvertent movement of the folding leg 200 toward the stored orientation. This may be accomplished with a lock 300, an embodiment of which is disclosed in FIGS. 8-11 and 20-27. In this embodiment, lock 300 comprises pins 320 that are slideable into and out of moveable step wing apertures 350 and moveable step center apertures 360. Pins 320 are preferably beveled on their ends to facilitate entry into apertures 350, 360. When in the in-use orientation, the respective moveable step wing apertures 350 align with respective moveable step center apertures 360 to allow pins 320 to traverse the apertures 350, 360 and lock the moveable step 230 in the in-use orientation (i.e., a continuous moveable step tread surface 235).

To release lock 300 to allow the folding leg 200 to move to a stored orientation, button 310 is pressed, which moves rod 340 and causes pin bar 330 to move away from moveable step 230, sliding pins 320 out of the apertures 350, 360. This disengagement of the pins 320 allows pivotal movement between moveable step center 260 and moveable step wings 270. Lock 300 is biased by spring 370 to maintain pins 320 in the locked position when the button 310 is not pressed. Other means of biasing the pins in the locked position known in the art may also be used. This lock 300 arrangement allows a user to push the button 310 with a foot while holding the upper portion of the stepladder 100 upright to release the lock 300. The moveable step 230 arrangement allows a user to hold the upper portion of the stepladder 100 while pushing down on the moveable step center 260 with a foot to move the moveable step 230 into an in-use orientation.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

We claim:

1. A folding leg for a stepladder, comprising:
a pair of rail legs, each rail leg having two ends;
a fixed rung connected to each rail leg;
a pair of leg hinges, each leg hinge attached to a rail leg end on a respective rail leg; and
a moveable step pivotably attached to each rail leg, the moveable step comprising:
a pair of moveable step wings; and
a moveable step center having two ends, the moveable step center pivotably attached at each end to a respective moveable step wing to allow vertical movement of the step center with respect to the fixed rung;
wherein the rail legs are moveable from a position in which the rail legs are parallel to a position in which the rail legs are askew.

2. The folding leg for a stepladder of claim 1 wherein each moveable step wing comprises a tread surface and the moveable step center comprises a tread surface.

3. The folding leg for a stepladder of claim 2 wherein the moveable step center tread surface and moveable step wings tread surfaces are parallel when the rail legs are askew.

4. The folding leg for a stepladder of claim 3 wherein the moveable step center tread surface and moveable step wings tread surfaces are coplanar when the rail legs are askew.

5. The folding leg for a stepladder of claim 1 further comprising a lock.

6. The folding leg for a stepladder of claim 5 wherein the lock is attached to the moveable step center.

7. The folding leg for a stepladder of claim 5 wherein the lock comprises:
a button:
a pin;
a moveable step wing aperture; and
a moveable step center aperture;
wherein pressing the button removes the pin from the moveable step wing aperture.

8. The folding leg for a stepladder of claim 7 further comprising a spring, the spring biasing the pin to remain in the step center aperture.

9. The folding leg for a stepladder of claim 7 wherein each moveable step wing comprises a tread surface and the moveable step center comprises a tread surface and wherein the moveable step center tread surface and moveable step wings tread surfaces are coplanar when the rail legs are askew.

10. The folding leg for a stepladder of claim 1 wherein the moveable step center is perpendicular to the rail legs when the folding leg is in the position in which the rail legs are parallel.

11. A stepladder comprising:
two front rails, each front rail having a top end and a bottom end;
a fixed rung connected to each front rail leg;
two rear rails, each rear rail pivotably connected to a respective front rail proximate the front rail top end;
a step;
two rail legs, each rail leg hingedly connected to a respective front rail proximate the front rail bottom end;
a moveable step pivotably attached to each rail leg, the moveable step comprising:
a pair of moveable step wings; and
a moveable step center having two ends, the moveable step center pivotably attached at each end to a respective moveable step wing to allow vertical movement of the step center with respect to the fixed rung;
wherein the rail legs are moveable from a position in which each rail leg is collinear to its respective front rail to a position in which each rail legs is not parallel to its respective front rail.

12. The stepladder of claim 11 wherein each moveable step wing comprises a tread surface and the moveable step center comprises a tread surface and wherein the moveable step center tread surface and moveable step wings tread surfaces are parallel when the rail legs are not parallel.

13. The stepladder of claim 12 wherein the moveable step center tread surface and moveable step wings tread surfaces are coplanar when the rail legs are not parallel.

14. The folding leg for a stepladder of claim 11 wherein the moveable step center is perpendicular to the front rails when the rail legs are in the position in which the rail legs are parallel.

15. The folding leg for a stepladder of claim 11 further comprising a lock, the lock comprising:
a button:
a pin;
a moveable step wing aperture; and
a moveable step center aperture;
wherein pressing the button removes the pin from the moveable step wing aperture.

16. The folding leg for a stepladder of claim 15 further comprising a spring, the spring biasing the pin to remain in the step center aperture.

17. A stepladder comprising:
two front rails, each front rail having a top end and a bottom end;
two rear rails, each rear rail pivotably connected to a respective front rail proximate the front rail top end;
a fixed step;
a pair of rail legs, each rail leg having two ends;
a pair of leg hinges, each leg hinge attached to a rail leg end on a respective rail leg; and
a moveable step pivotably attached to each rail leg, the moveable step comprising:
a pair of moveable step wings each step wing comprising a tread surface; and
a moveable step center comprising two ends and a tread surface, the moveable step center pivotably attached at each end to a respective moveable step wing to allow vertical movement of the step center with respect to the fixed rung while maintaining a parallel relationship between the fixed step and step center;
wherein the rail legs are moveable from a position in which the rail legs are parallel the front rails to a position in which the rail legs are askew and the moveable step center tread surface is parallel to the step.

18. The stepladder of claim 17 further comprising a lock.

19. The stepladder of claim 18 wherein the lock comprises:
a button:
a pin;
a moveable step wing aperture; and a moveable step center aperture;

wherein pressing the button removes the pin from the moveable step wing aperture.

20. The folding leg for a stepladder of claim 19 wherein the moveable step center tread surface and moveable step wings tread surfaces are coplanar when the rail legs are askew.

* * * * *